US006490744B1

(12) United States Patent
Schulz, Jr.

(10) Patent No.: US 6,490,744 B1
(45) Date of Patent: Dec. 10, 2002

(54) POCKETED BEDDING OR SEATING PRODUCT WITH CUSHIONING PADS INSIDE POCKETS

(75) Inventor: Martin Schulz, Jr., Brenham, TX (US)

(73) Assignee: L&P Property Management Company, South Gate, CA (US)

( * ) Notice: Subject to any disclaimer, the term of this patent is extended or adjusted under 35 U.S.C. 154(b) by 63 days.

(21) Appl. No.: 09/704,399

(22) Filed: Nov. 2, 2000

(51) Int. Cl.[7] ..... A47C 27/04
(52) U.S. Cl. ..... 5/720; 5/716
(58) Field of Search ..... 5/716, 720, 655.7, 5/655.8; 267/89, 90, 91

(56) References Cited

U.S. PATENT DOCUMENTS 3,083,381 A * 4/1963 Bailey ..... 219/217
3,122,829 A 3/1964 Schaad et al.
3,160,894 A * 12/1964 Frey ..... 5/243
4,429,427 A 2/1984 Sklar
4,862,540 A 9/1989 Savenije

FOREIGN PATENT DOCUMENTS

| | | |
|---|---|---|
| FR | 657648 | 5/1929 |
| GB | 133213 | 10/1919 |
| GB | 376291 | 7/1932 |

* cited by examiner

*Primary Examiner*—Heather Shackelford
*Assistant Examiner*—Fredrick Conley
(74) *Attorney, Agent, or Firm*—Wood, Herron & Evans, L.L.P.

(57) ABSTRACT

A bedding or seating product comprising a spring assembly made of a plurality of strings of springs connected to each other. Each string of springs comprises a plurality of individually pocketed coil springs. Within each pocket is a coil spring and at least one cushioning pad secured to the coil spring. In one embodiment, one cushioning pad is secured to the upper end turn of the coil spring. In an alternative embodiment, cushioning pads are secured to the upper and lower end turns of the coil spring.

26 Claims, 5 Drawing Sheets

POCKETED BEDDING OR SEATING PRODUCT WITH CUSHIONING PADS INSIDE POCKETS

FIELD OF THE INVENTION

This invention relates to spring assemblies for mattresses, cushions and other bedding or seating products.

BACKGROUND OF THE INVENTION

A known form of pocketed spring assembly comprises a plurality of parallel strings of springs joined together either by gluing, clipping or otherwise securing the strings of springs to each other. Each string of springs comprises a strip of fabric wrapped around a plurality of coil springs which are aligned in a row. The coil springs may be part of a continuous band of coil springs made of one piece of wire such as disclosed in assignee's U.S. Pat. No. 5,127,635, or alternatively may be individual coil springs such as disclosed in U.S. Pat. No. 4,854,023.

The strings of springs may extend longitudinally or transversely depending on the desired application.

Once a plurality of strings of springs are secured together so as to create a spring assembly, a pair of generally rectangular border wires may be connected to the spring assembly around the periphery thereof. Padding is placed over the spring assembly and the padding and spring assembly encased in an upholstered material as is conventional.

In order to create such a string of springs, a plurality of coil springs are aligned in a row and a strip of fabric is wrapped around the aligned row of coil springs so as to create two plies, one on either side of the row of springs. The edges of the strip of fabric are joined together with a longitudinal line of attachment extending longitudinally along the row of springs. The outermost edges of the strip of fabric are joined together with outermost transverse lines of attachment in order to prevent the outermost springs from falling out of the strip of fabric. Between adjacent coil springs transverse lines of attachment extend generally parallel the axis of the coil springs, separating the strip of fabric into individual pockets, each pocket containing a coil spring, such as is disclosed in assignee's U.S. patent application Ser. No. 09/307,501.

In assignee's U.S. Pat. No. 5,127,635, a pair of coil springs are located within each pocket rather than each pocket containing a coil spring. In this arrangement a transverse line of attachment exists between every other spring rather than between adjacent springs.

Rather than placing foam or other cushioning or padding materials on top of the upper surface of a spring assembly as is conventional, spring assemblies have been constructed utilizing strings of springs in which the cushioning or padding material is built into the string of springs.

U.S. Pat. No. 3,160,894 discloses a plurality of strings of springs joined to a wooden base. Each string of springs has a strip of padding material comprising foam or other similar material placed on top of the upper end turns of a row of springs, the strip of padding material and springs being encased in fabric. In this patent, the coil springs within each string are not located within individual pockets separated from one another. Rather, the coil springs are stapled to a base in order to keep the coil springs in place.

Similarly, French Patent No. 657648 discloses a product comprising a plurality of strings of springs placed inside compartments of fabric, each string of springs comprising a plurality of individual coil springs separated by dividers of fabric. A strip of padding material is located above the string of coil springs and inserted into one of the compartments above the string of springs.

Although these two patents do disclose continuous strips of padding incorporated into or used with a string of springs, the springs are not individually pocketed as in applicant's invention. Furthermore, these strings of springs lack a strip of fabric surrounding a row of springs, opposite plies of the strip of fabric being secured together so as to separate the springs.

Therefore, it has been one objective of the present invention to provide a bedding or seating product with improved responsiveness to a load placed on the product.

It has further been an objective of the present invention to provide a bedding or seating product which contains cushioning material within each pocket.

It has further been an objective of the present invention to provide a bedding or seating product which does not require large amounts of cushioning or padding material to be placed on top of the bedding or seating product once the spring assembly is complete.

SUMMARY OF THE INVENTION

The pocketed bedding or seating product of the present invention which accomplishes these objectives comprises a plurality of parallel strings of individually pocketed coil springs. Adjacent strings of springs are joined to each other using conventional methods such as gluing, ultrasonic welding, or using conventional fasteners such as hog rings. The assembly of parallel strings of springs may then be joined to upper and lower generally rectangular border wires located in the top and bottom planes of the bedding or seating product. In order to complete the bedding or seating product of the present invention, a covering pad may be placed over the spring assembly and an upholstered covering placed around the covering pad and the spring assembly.

Each string of springs comprises a row of individual coil springs, a strip of fabric surrounding the coil springs and a plurality of cushioning pads placed on top of the coil springs inside the fabric. The strip of fabric is divided into a plurality of pockets by spaced transverse lines of attachment, each pocket containing one of the coil springs and at least one cushioning pad located above the coil spring. An additional cushioning pad or pads may be located below the coil spring within the pocket.

Each coil spring has an upper end turn, a lower end turn and a plurality of convolutions between the end turns defining a spring axis. Although this application illustrates and describes individual coil springs incorporated into the string of springs, it is within the contemplation of the present invention to use continuous bands of springs, each band being made of one piece of wire such as those disclosed in U.S. Pat. No. 5,127,635.

In one preferred embodiment of the present invention, a first cushioning pad is located within each pocket and is secured to the upper end turn of the coil spring within the pocket. In an alternative preferred embodiment of the present invention, a first cushioning pad is secured to the upper end turn of the coil spring within each pocket and a second cushioning pad is secured to the lower end turn of the same coil spring within the pocket, thus each pocket contains two cushioning pads located above and below the end turns of the coil spring.

In forming a string of springs, once a strip of fabric has been wrapped around a row of aligned coil springs, the longitudinal edges of the strip of fabric are joined together with a longitudinal line of attachment in any known manner, such as sewing, welding or gluing. Opposed plies of the strip of fabric on opposite sides of the coil springs are joined together between the coil springs with transverse lines of attachment, which similarly may be ultrasonic welds, sewing lines, glue lines or any other means of attaching the plies to each other.

Each pocket contains at least one cushioning pad. Each cushioning pad comprises at least one piece of foam. The cushioning pad is illustrated and described as being a piece of urethane foam sandwiched between two pieces of cloth, one of the pieces of cloth being glued or otherwise secured to the end turn of the coil spring. However, it is within the contemplation of the present invention that the cushioning pad comprise multiple pieces of foam. In addition to foam, other materials such as cotton may be used to form the cushioning pad.

By securing at least one cushioning pad to the spring within each individual pocket, each coil spring functions independently, resulting in a more comfortable bedding or seating product than heretofore known pocketed products.

DETAILED DESCRIPTION OF THE DRAWINGS

Figure 1:
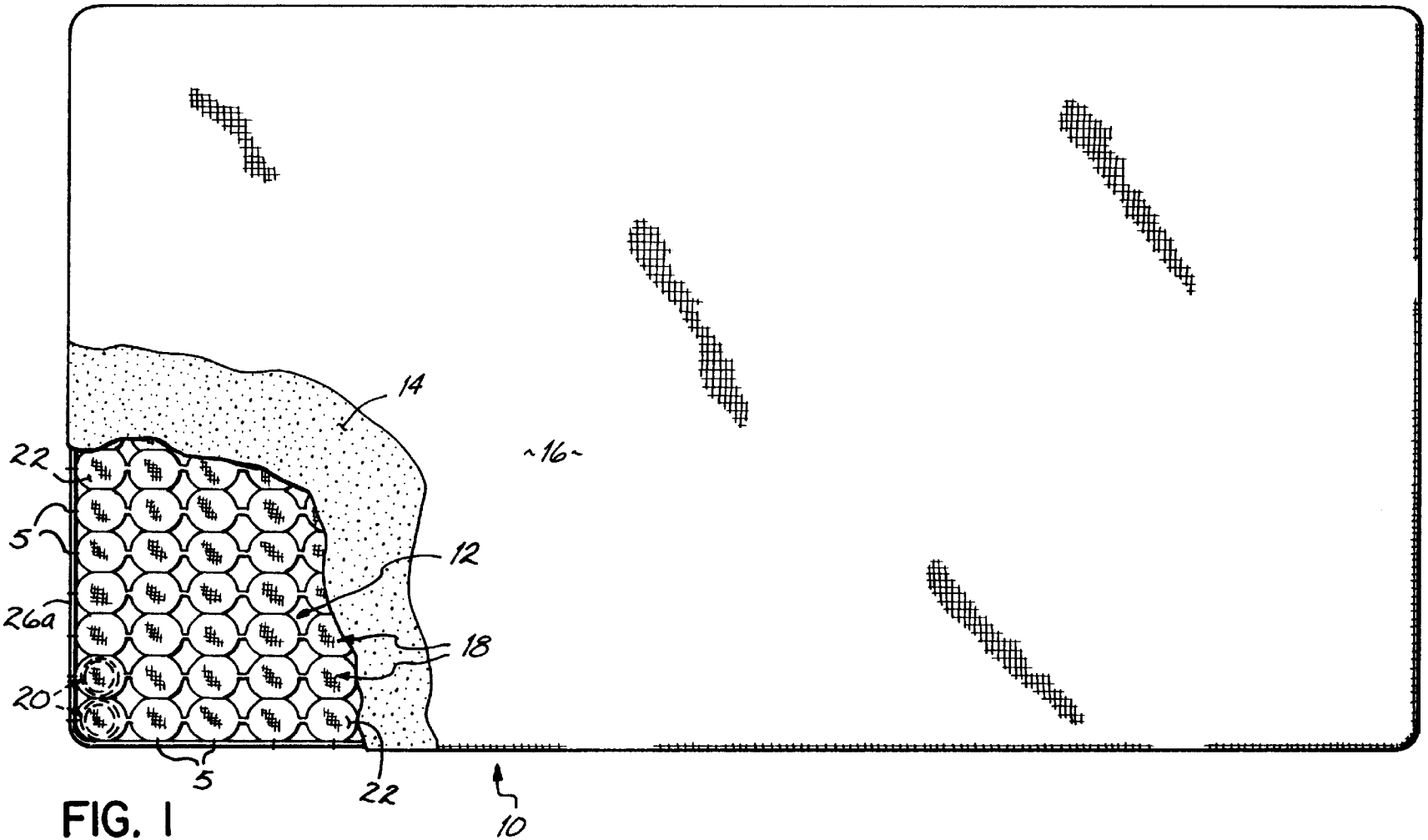
FIG. 1 is a top plan view, partially broken away, of a bedding product embodying the invention of this application, the product having longitudinally extending strings of springs.
Figure 4:
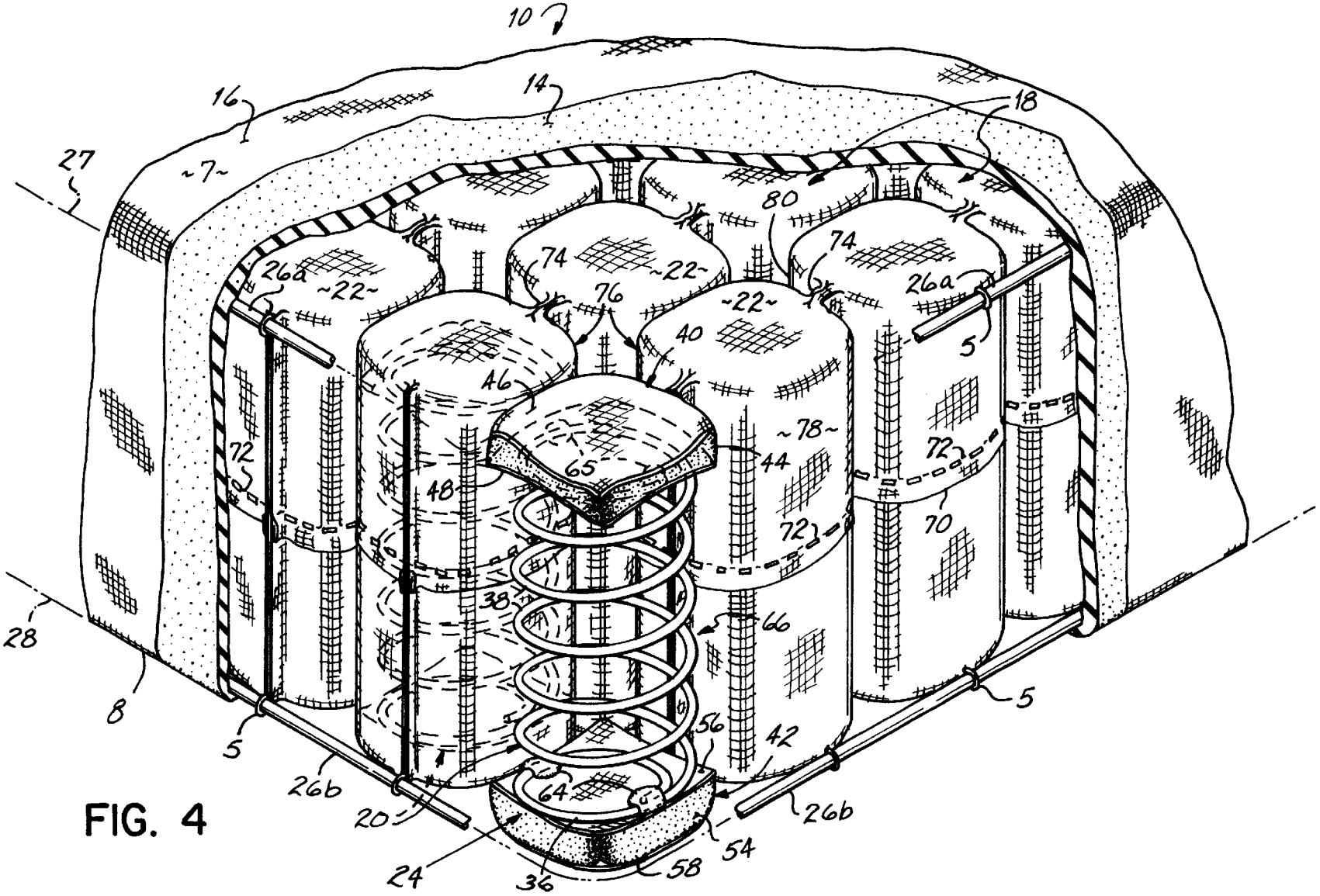
FIG. 4 is a perspective view partially broken away of one corner of the spring assembly of FIG. 1.

With reference first to FIGS. 1 and 4, there is illustrated a mattress 10 embodying the invention of this application. Although a mattress is illustrated, the present invention may be used to construct any bedding or seating product. This mattress 10 comprises a pocketed spring assembly 12 on the top and bottom surfaces of which there is a covering pad 14. An upholstered covering 16 encases the spring assembly 12 and the covering pads 14. Additional layers of padding may be added if desired. If desired, the covering pads 14 may be omitted.

The spring assembly 12 is formed from a plurality of parallel strips or strings 18 of individually pocketed coil springs 20. As best illustrated in FIG. 4, each string 18 of pocketed coil springs 20 comprises a fabric covering or strip of fabric 22 within which there is located a row or column 24 of aligned coil springs 20. Adjacent strings of springs 18 are secured to each other by gluing, ultrasonic welding, hog rings or any other means. The strings 18 may be secured to top and bottom border wires 26*a,b* by conventional hog rings 5 or secured to the border wires with any other type of fasteners.

Figure 2:
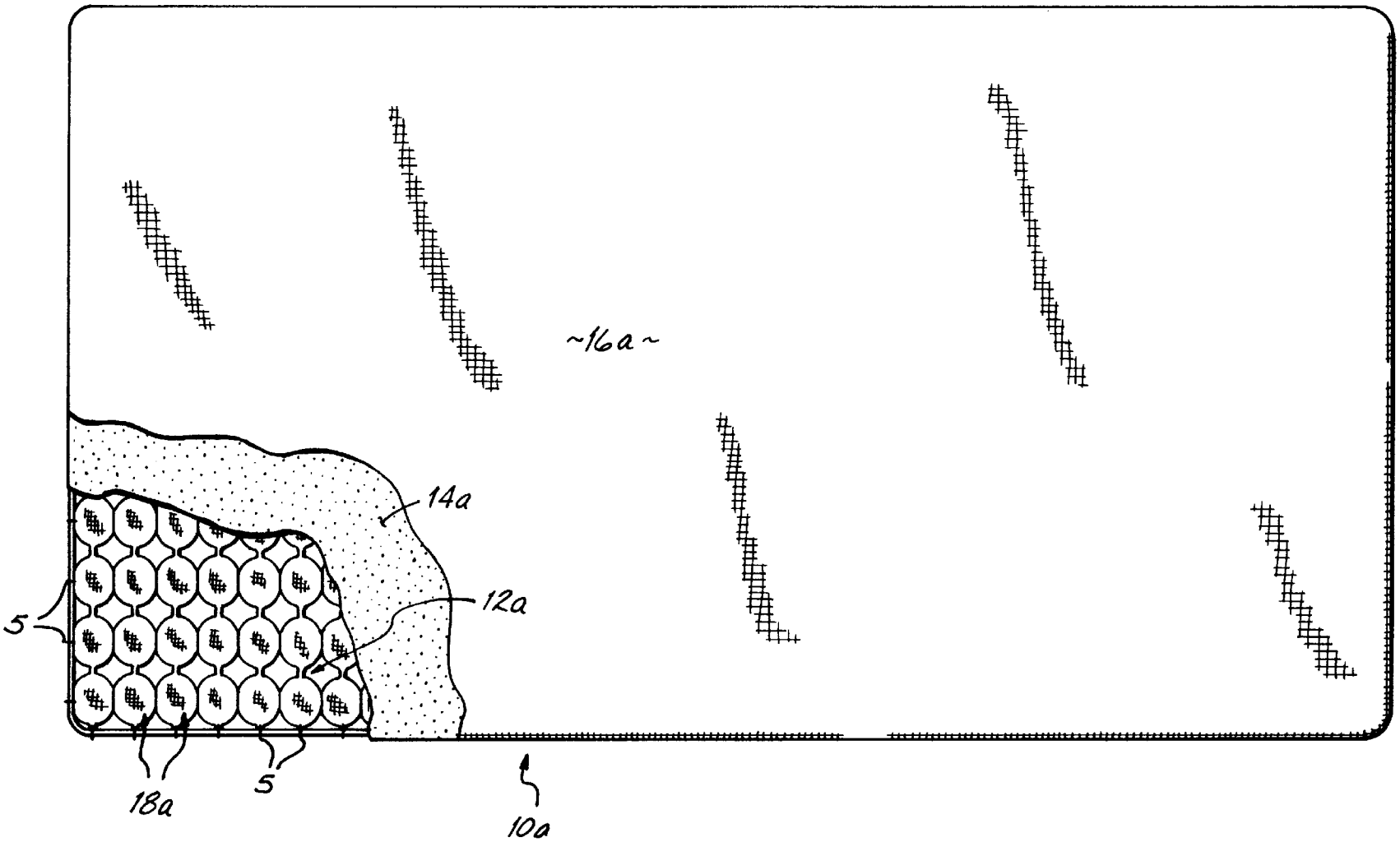
FIG. 2 is a top plan view, partially broken away, of a bedding product with transversely extending strings of springs.

Although FIGS. 1 and 4 illustrate the strings 18 extending longitudinally of the mattress 10, the strings may extend transversely of the mattress as well (from side to side) as illustrated in FIG. 2. FIG. 2 illustrates a mattress 10*a* having a pocketed spring assembly 12*a*, a covering pad 14*a* and an upholstered covering 16*a*. The pocketed spring assembly 12*a* comprises a plurality of parallel strings of springs 18*a* extending from side to side or transversely.

As illustrated in FIG. 4, the mattress 10 has a generally planar top surface 7 defining a top plane 27 and a generally planar bottom surface 8 defining a bottom plane 28. The border wires 26*a,b* are located in the top and bottom planes 27,28, respectively, of the mattress and extend completely around the periphery of the spring assembly 12. If desired the border wires may be omitted.

The border wires 26*a*,26*b* are secured to the outermost coil springs 20 of each string 18 of springs and additionally to the coil springs 20 of the outermost strings of springs extending along the longitudinal side edges of the product.

Figure 3:
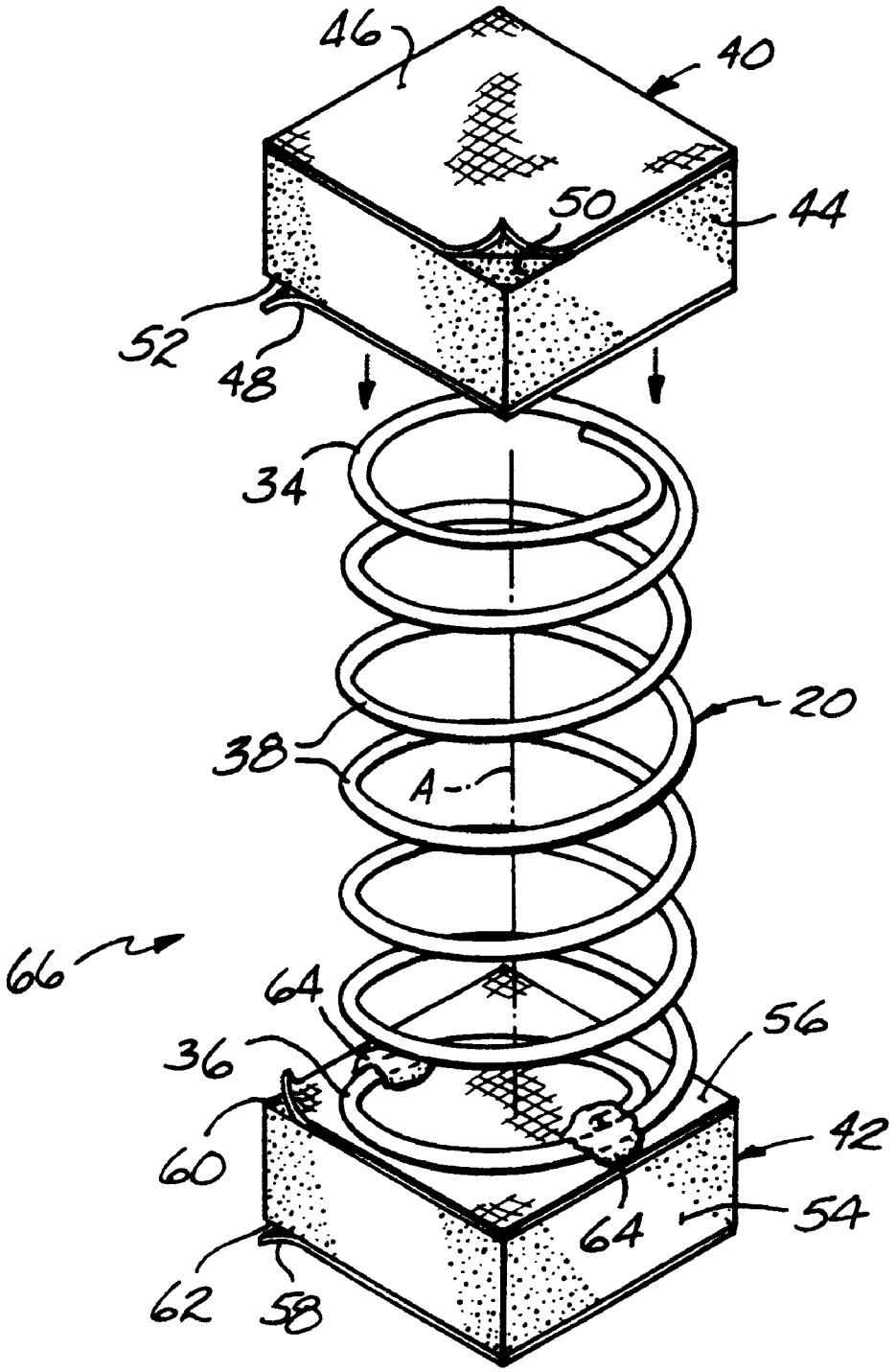
FIG. 3 is a partially disassembled perspective view of a coil spring with a pair of cushioning pads.

As illustrated in FIG. 3, each coil spring 20 has an upper end turn 34, a lower end turn 36 and a plurality of central convolutions 38 between the end turns 34,36. Although the central convolutions 38 are illustrated as being of an identical diameter, they may be of varying diameters, in the form of an hour-glass-shaped coil spring or any other shapes of springs. The central convolutions 38 define a coil spring axis A.

A first cushioning pad 40 is secured to the upper end turn 34 of the coil spring 20 and a second cushioning pad 42 is secured to the lower end turn 36 of the coil spring 20. The first cushioning pad 40 comprises a foam center piece 44, an upper fabric piece 46 and a lower fabric piece 48. The foam center piece 44 is sandwiched between the upper and lower fabric pieces 46,48 as illustrated in FIG. 3. The upper fabric piece 46 is glued or otherwise secured to the upper surface 50 of the foam center piece 44. Similarly, the lower fabric piece 48 is secured by gluing or any other suitable means to a lower surface 52 of the foam center piece 44.

Similarly, the second cushioning pad 42 comprises a foam center piece 54 sandwiched between an upper fabric piece 56 and a lower fabric piece 58. The upper fabric piece 56 is glued or otherwise secured to an upper surface 60 of the foam center piece 54. Similarly, the lower fabric piece 58 is glued or otherwise secured to a lower surface 62 of the foam center piece 54.

Although the cushioning pads 40 and 42 are illustrated as being generally square in shape, they may alternatively be any other shape or configurations, such as foam cylinders, rectangles or any other desired shape. Similarly, the height of the cushioning pads may be varied as deemed appropriate and suitable for any particular application.

As illustrated in FIG. 3, the second cushioning pad 42, and more particularly the upper fabric piece 56 of the cushioning pad 42, is glued or otherwise secured to the lower end turn 36 of the coil spring 20 with a pair of opposed glue spots 64. Similarly, the first cushioning pad 40, and more particularly the lower fabric piece 48 of the first cushioning pad 40, is glued or otherwise secured to the upper end turn 34 of the coil spring 20 in a similar fashion, with glue spots 65 (see FIG. 4). Other suitable means of securing the cushioning pads to the end turns of the coil spring may be used other than gluing.

Although each cushioning pad is illustrated as comprising one foam piece and a pair of cloth pieces, the cushioning pad of the present invention may comprise multiple pieces of foam with or without any cloth pieces. The foam piece may be made of polyurethane or any other conventional foam material. Alternatively, pads of cotton or any other material may be used.

Referring to FIG. 4, each coil spring 20 and pair of cushioning pads 40,42 will be referred to in this application as a cushioned spring 66. As best illustrated in FIG. 4, each string of springs 18 comprises a plurality of cushioned springs 66 place inside individual pockets. Each string of springs 18,18*a* contains either a longitudinally extending column of cushioned springs 66 (see FIG. 1) or a transversely extending row of cushioned springs 66 (see FIG. 2), depending upon the orientation of the strings. A strip of fabric 22 is wrapped around the row or column of cushioned springs 66. By wrapping the strip of fabric 22 around the row of aligned coil springs, a first ply 78 of fabric and a second ply 80 of fabric are created, the plies being on opposite sides of the cushioned coil springs 66. Opposite longitudinally extending edges 70 of the strip of fabric 22 are joined together with a longitudinal line of attachment 72 (see FIG. 4). The first and second plies 78,80 of the strip of fabric 22 are joined together by spaced transverse lines of attachment 74 dividing the fabric 22 into a plurality of pockets 76. Each pocket 76 contains one coil spring 20 and a pair of cushioning pads 40,42, otherwise referred to as a cushioned spring 66.

Figure 5:
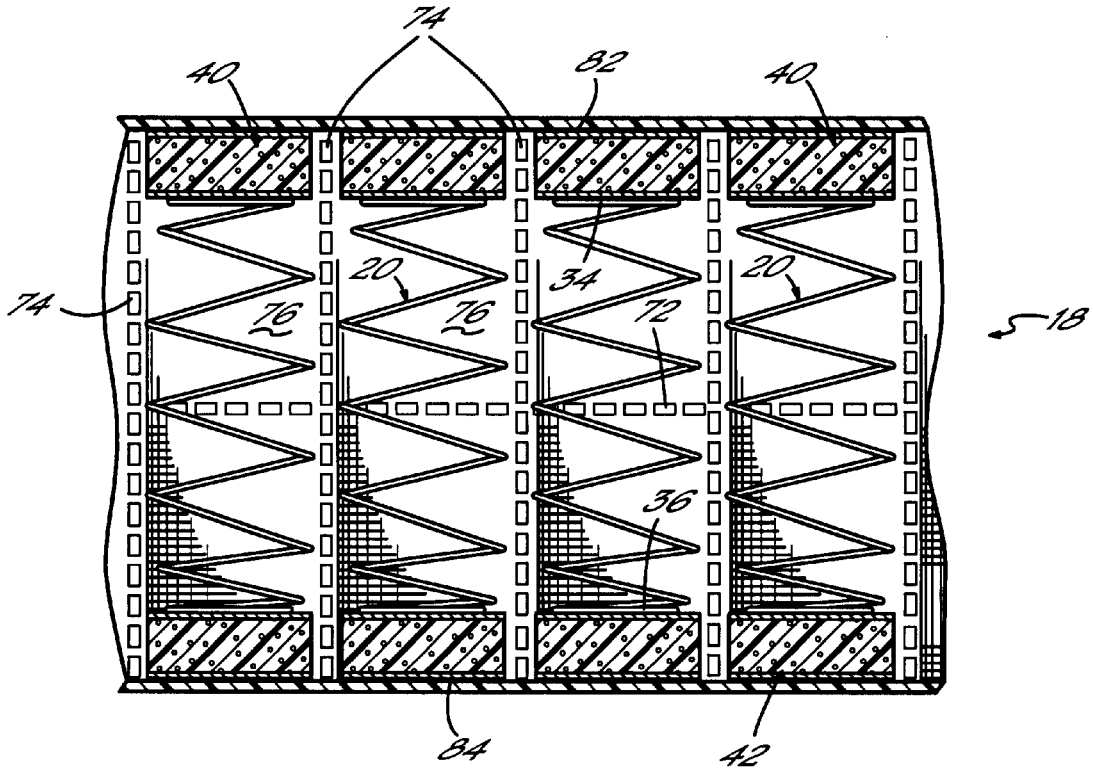
FIG. 5 is a cross-sectional side view of a portion of a string of springs of the fist preferred embodiment of the present invention illustrated in FIGS. 1–4.

As best illustrated in FIG. 5, each transverse line of attachment 74 extends generally from an upper surface 82 of the string of springs 18 to a lower surface 84 of the string of springs, and thus extends approximately the entire height of the string of springs. However, the transverse lines of attachment 74 may be any desired length. In addition, multiple transverse lines of attachment 74 may exist between adjacent pockets 76.

Figure 6:
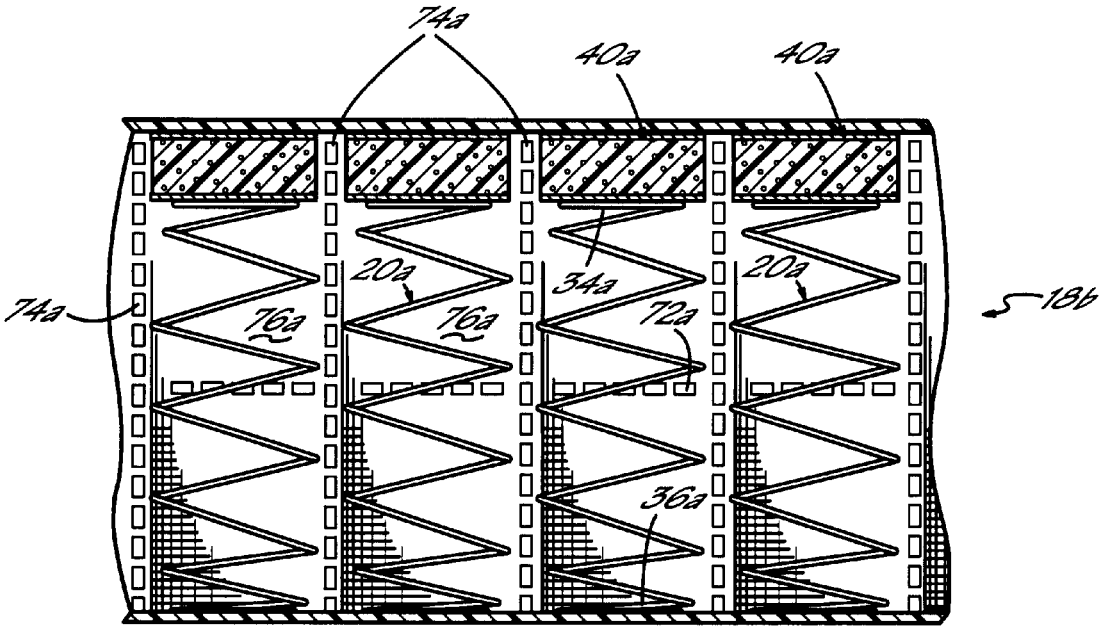
FIG. 6 is a side elevational view of a portion of a string of springs of an alternative preferred embodiment of the present invention.

FIG. 6 illustrates an alternative preferred embodiment of the present invention. For the sake of simplicity, like numbers will be used for this embodiment as those used in the embodiment illustrated in the first preferred embodiment illustrated in FIGS. 1–5. In this embodiment, each string of springs 18*a* is divided into pockets 76*a* with transverse lines of attachment 74*a*, each pocket 76*a* containing a coil spring 20*a* having only one cushioning pad 40*a* secured to the upper end turn 34*a* of the coil spring. This preferred embodiment of the present invention thus creates an essentially one-sided product, whereas the first preferred embodiment constitutes what is generally referred to in the industry as a two-sided product, both the upper and lower surfaces of the product being cushioned.

While I have described only two preferred embodiments of the present invention, persons skilled in the art will appreciate changes and modifications which may be made to the invention without departing from the spirit of the invention. For example, the present invention may be used with non-coil-type springs or with continuous bands of springs. Also, by varying the characteristics of either the cushioning pads or coil springs, a posturized product may be created. Therefore, I intend to be limited only by the scope of the following claims.

I claim:

1. A bedding or seating product comprising:

a spring assembly comprising a plurality of parallel strings of individually pocketed coil springs, each of said coil springs having an upper end turn, a lower end turn and a plurality of convolutions between said end turns, each of said strings of individually pocketed coil springs comprising a plurality of aligned coil springs, a strip of fabric surrounding said aligned coil springs, said strip of fabric being divided into a plurality of pockets by spaced transverse lines of attachment, each pocket containing one of said coil springs and a cushioning pad located above said upper end turn of said coil spring, said cushioning pad including at least one piece of foam, a covering pad overlying said spring assembly; and an upholstered covering encasing said covering pad and said spring assembly.

2. A bedding or seating product comprising:

a spring assembly comprising a plurality of parallel strings of individually pocketed coil springs, each of said coil springs having an upper end turn, a lower end turn and a plurality of convolutions between said end turns, each of said strings of individually pocketed coil springs comprising a plurality of aligned coil springs, a strip of fabric surrounding said aligned coil springs, said strip of fabric being divided into a plurality of pockets by spaced transverse lines of attachment, each pocket containing one of said coil springs and a cushioning pad located above said upper end turn of said coil spring, said cushioning pad including at least one piece of foam.

3. The bedding or seating product of claim 2 wherein each of said strings of springs has a longitudinal line of attachment.

4. The bedding or seating product of claim 2 wherein said transverse lines of attachment join a first ply to a second ply of said strip of fabric.

5. The bedding or seating product of claim 2 wherein said cushioning pad comprises a piece of foam sandwiched between pieces of cloth.

6. A bedding or seating product comprising:

a spring assembly comprising a plurality of parallel strings of individually pocketed springs, each of said coil springs having an upper end turn, a lower end turn and a plurality of convolutions between said end turns, a cushioning pad secured to said upper end turn of said coil spring, said cushioning pad including at least one piece of foam, a piece of fabric surrounding said coil spring and said cushioning pad.

7. The bedding or seating product of claim 6 wherein said cushioning pad comprises a piece of foam sandwiched between pieces of cloth.

8. The bedding or seating product of claim 7 wherein one of said pieces of cloth is secured to said upper end turn of said coil spring.

9. A bedding or seating product comprising:

a spring assembly comprising a plurality of parallel strings of individually pocketed coil springs, each of said coil springs having an upper end turn, a lower end turn and a plurality of convolutions between said end turns, each of said strings of individually pocketed coil springs comprising a plurality of aligned coil springs, a strip of fabric surrounding said aligned coil springs, said strip of fabric being divided into a plurality of pockets by spaced transverse lines of attachment, each pocket containing one of said coil springs and a cushioning pad located above said upper end turn of said coil spring and a cushioning pad located below said lower end turn of said coil spring, each of said cushioning pads including at least one piece of foam.

10. The bedding or seating product of claim 9 wherein said cushioning pads are secured to said end turns of said coil springs.

11. The bedding or seating product of claim 9 wherein each of said strings of springs has a longitudinal line of attachment.

12. The bedding or seating product of claim 9 wherein said transverse lines of attachment join a first ply to a second ply of said strip of fabric.

13. The bedding or seating product of claim 9 wherein each of said cushioning pads comprises a piece of foam sandwiched between pieces of cloth.

14. A pocketed coil spring for use in a bedding or seating product, said pocketed coil spring comprising:

a coil spring having an upper end turn, a lower end turn and a plurality of convolutions between said end turns, a cushioning pad located above upper end turn of said coil spring, and secured thereto, said cushioning pad including at least one piece of foam, and a single piece of fabric surrounding said coil spring and said cushioning pad.

15. The pocketed coil spring of claim 14 wherein said cushioning pad comprises a piece of foam sandwiched between pieces of fabric.

16. The pocketed coil spring of claim 14 wherein said cushioning pad has a square configuration.

17. The pocketed coil spring of claim 14 wherein each piece of foam is made of urethane.

18. A pocketed coil spring for use in a bedding or seating product, said pocketed coil spring comprising:

a coil spring having an upper end turn, a lower end turn and a plurality of convolutions between said end turns, a first cushioning pad secured to said upper end turn of said coil spring and a second cushioning pad secured to said lower end turn of said coil spring, each of said cushioning pads including at least one piece of foam, a single piece of fabric surrounding said coil spring and said cushioning pads.

19. The pocketed coil spring of claim 18 wherein each of said cushioning pads comprises a piece of cloth secured to a piece of foam.

20. The pocketed coil spring of claim 18 wherein said cushioning pads are glued to said end turns of said coil spring.

21. A pocketed coil spring for use in a bedding or seating product, said pocketed coil spring comprising:

a coil spring having an upper end turn, a lower end turn and a plurality of convolutions between said end turns, a compressible cushioning pad located above upper end turn of said coil spring, and secured thereto, and a single piece of fabric surrounding said coil spring and said cushioning pad.

22. The pocketed coil spring of claim 21 wherein said cushioning pad includes at least one piece of urethane foam.

23. A pocketed coil spring for use in a bedding or seating product, said pocketed coil spring comprising:

a coil spring having an upper end turn, a lower end turn and a plurality of convolutions between said end turns, a first compressible cushioning pad located above said upper end turn of said coil spring and a second compressible cushioning pad located below said lower end turn of said coil spring, fabric surrounding said coil spring and said cushioning pads.

24. The pocketed coil spring of claim 23 wherein each of said cushioning pads includes at least one piece of foam.

25. A bedding or seating product comprising:

a plurality of coil springs, each of said coil springs having an upper end turn, a lower end turn and a plurality of convolutions between said end turns, a first compressible cushioning pad located above said upper end turn of each of said coil springs, fabric surrounding each of said coil springs and said cushioning pad located above said coil spring.

26. The bedding or seating product of claim 25 and further comprising a second compressible cushioning pad located below said lower end turn of said coil spring.

* * * * *